US007394307B2

(12) United States Patent
Negoro et al.

(10) Patent No.: US 7,394,307 B2
(45) Date of Patent: Jul. 1, 2008

(54) VOLTAGE REGULATOR HAVING REVERSE VOLTAGE PROTECTION AND REVERSE CURRENT PREVENTION

(75) Inventors: Takaaki Negoro, Osaka (JP); Koichi Morino, Kanagawa (JP)

(73) Assignee: Ricoh Company, Ltd. (JP)

( * ) Notice: Subject to any disclaimer, the term of this patent is extended or adjusted under 35 U.S.C. 154(b) by 0 days.

(21) Appl. No.: 11/313,640

(22) Filed: Dec. 22, 2005

(65) Prior Publication Data

US 2006/0138546 A1 Jun. 29, 2006

(30) Foreign Application Priority Data

Dec. 22, 2004 (JP) ..... 2004-370538

(51) Int. Cl.
*G05F 1/10* (2006.01)
*G05F 3/02* (2006.01)

(52) U.S. Cl. ..... 327/541; 327/536; 327/537; 257/392; 257/355; 365/185.18; 365/185.21; 365/185.23; 326/30; 363/60; 323/281

(58) Field of Classification Search ..... 327/536, 327/537, 541; 257/392, 355; 365/185.18, 365/185.21, 185.23; 326/30; 363/60; 323/281
See application file for complete search history.

(56) References Cited

U.S. PATENT DOCUMENTS 5,376,840 A * 12/1994 Nakayama ..... 327/537
5,561,385 A * 10/1996 Choi ..... 327/536
6,046,624 A * 4/2000 Nam et al. ..... 327/530
2002/0053943 A1 * 5/2002 Yamasaki et al. ..... 327/538
2002/0118568 A1 * 8/2002 Tanzawa ..... 365/185.11
2003/0112056 A1 * 6/2003 Tanzawa et al. ..... 327/536

FOREIGN PATENT DOCUMENTS

JP 04-162111 6/1992
JP 2002-268758 9/2002

OTHER PUBLICATIONS http://www.core.org.cn/CN_NR/rdonlyres/Electrical-Engineering-and Computer-Science/6-012Microelectronic-Devices-and-CircuitsSpring2003/F7C787D1-1FC3-41D4-898C-5D83C7A5A228/0/lecture13.pdf.*

* cited by examiner

*Primary Examiner*—Meiya Li
(74) *Attorney, Agent, or Firm*—Dickstein Shapiro LLP

(57) ABSTRACT

A voltage regulator having a MOS transistor driver includes a p-channel MOS transistor at a voltage input terminal Vin and a p-channel MOS transistor at a voltage output terminal Vout. A drain of the input side p-channel MOS transistor is connected to the voltage input terminal Vin. A threshold voltage or a voltage lower than the threshold voltage is applied to a gate of the input side p-channel MOS transistor. A drain of the output side p-channel MOS transistor is connected to the voltage output terminal Vout. A current flowing through the input side p-channel MOS transistor drives a voltage regulator circuit and the output side p-channel MOS transistor.

5 Claims, 5 Drawing Sheets

VOLTAGE REGULATOR HAVING REVERSE VOLTAGE PROTECTION AND REVERSE CURRENT PREVENTION

The present application is based on Japanese Priority Application No. 2004-370538 filed on Dec. 22, 2004 with the Japanese Patent Office, the entire contents of which are hereby incorporated by reference.

BACKGROUND OF THE INVENTION

1. Field of the Invention

The present invention generally relates to a voltage regulator, and specifically relates to CMOS voltage regulators used in vehicles or industrial machines and CMOS voltage regulators connected to batteries.

2. Description of the Related Art

Parasitic PN junctions are undesirably generated between a source and a well, and a drain and the well of an n-channel MOS transistor as shown in FIG. 4. Therefore, two diodes D1 and D2 are formed in the MOS transistor. In the n-channel transistor shown in FIG. 4, the p-well is connected to ground.

There is no problem when a drain voltage is higher than a well voltage. When the drain voltage is lower than the well voltage by −0.7 V or more, the PN diode D2 turns on and a large forward current flows through the diode D2.

Similarly, in a p-channel MOS transistor, when a drain voltage is higher than a well voltage by 0.7 V or more, a PN diode turns on and a large forward current flows through the diode.

In general, a well of a MOS transistor is formed on a P substrate as shown in FIG. 6. In the p-channel MOS transistor having a normal PNP junction shown in FIG. 6, a parasitic vertical PNP bipolar transistor formed by a source (p+), a well (n) and the substrate (p) is generated inside. When input side current driving power becomes lower than the output side current driving power, a current does not flow through the normal PNP junction MOS transistor, but the parasitic vertical PNP bipolar transistor turns on, through which a current $I_0$ undesirably flows.

A scheme for inhibiting such a reverse current from an output terminal to an input terminal is proposed in a DC power supply circuit disclosed in Japanese Publication H7-69749. In the DC power supply circuit, a back gate voltage of a power MOS transistor is changed to a voltage that turns off a parasitic diode generated between a source and a drain of the power MOS transistor, in order to inhibit the reverse current from the output terminal to the input terminal.

The DC power supply circuit includes a back gate control circuit for controlling the back gate voltage so as to turn off the parasitic diode. The back gate control circuit comprises two stage inverters formed by p-channel MOS transistors and n-channel MOS transistors. The drains of the post stage p-channel and n-channel MOS transistors are connected together, and the connecting node is connected to the back gate of the power MOS transistor.

FIG. 5 is a circuit diagram of a conventional voltage regulator circuit.

In recent years and continuing, in voltage regulator products, low dropout products formed by CMOS transistors are remarkably popular because of their low current consumption. In such products, a p-channel transistor M30 is used as an output control transistor. When an input voltage Vin becomes lower than GND voltage by −0.7 V or more in a case of power shut down, for example, PN diodes formed between drains and wells in MOS transistors included in a reference voltage circuit 51 (providing a reference voltage VREF) and an operational amplifying circuit 21 are forwardly biased, and accordingly a large current flows from GND to the input Vin. This phenomenon may cause equipment malfunction or breakdown.

In order to avoid such a problem, it is generally regulated so that a voltage lower than −0.3 V is not applied to an input of the CMOS voltage regulator.

A CMOS voltage regulator has a problem in that when its output voltage becomes higher than its input voltage, a PN junction between a drain and a well in an output controlling p-channel MOS transistor is forwardly biased and a large current flows from an output terminal to an input terminal.

This phenomenon also may cause equipment malfunction or breakdown.

On the other hand, bipolar transistors with an opened base do not allow current to flow unless a considerably large voltage is applied between a collector and emitter.

Therefore, some bipolar voltage regulators have no problem even if a large reverse voltage is applied to an input. However, a forward diode has to be inserted at an input terminal, and accordingly a voltage higher than a forward voltage (a threshold voltage) has to be applied to the input terminal and low dropout products cannot be provided.

As explained above,-in conventional voltage regulators having a MOS transistor, when a reverse voltage is applied to an input terminal, a forward current flows between a drain and a well in a p-channel MOS transistor, and therefore a large current flows from an output terminal to the input terminal, causing equipment malfunction and breakdown.

In a case where current driving power of an input terminal side p-channel MOS transistor is lower than the current driving power of an output terminal side p-channel MOS transistor, a parasitic diode formed by a drain and an n-well of the input terminal p-channel MOS diode turns on, or a parasitic vertical PNP bipolar transistor formed by a p-source, the n-well and a p-substrate turns on, causing equipment malfunction or breakdown.

SUMMARY OF THE INVENTION

Accordingly, the present invention provides a voltage regulator with low current consumption in which reverse voltage protection is given and reverse current prevention is attained.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by a charging system particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides as follows.

According to one feature of the present invention, there is provided a voltage regulator having a voltage input terminal and a voltage output terminal, comprising: a first p-channel MOS transistor and a second p-channel MOS transistor connected in series between the voltage input terminal and the voltage output terminal, the first p-channel MOS transistor having a drain connected to the voltage input terminal and a gate to which a threshold or lower voltage is applied, the second p-channel MOS transistor having a drain connected to the voltage output terminal; and a voltage regulator circuit comprising an operational amplifier, a reference voltage circuit and a resistance voltage divider; wherein the voltage regulator circuit and the second p-channel MOS transistor are driven by a current flowing through the first p-channel MOS transistor.

The voltage regulator may further comprise: a cut-off circuit including an equalizer that equalizes gate and source voltages of the first p-channel MOS transistor to stop a current from the voltage output terminal to the voltage input terminal when a voltage at the voltage output terminal is higher than a voltage at the voltage input terminal.

The voltage regulator may further comprise: a signal input terminal; and a third p-channel MOS transistor disposed at the signal input terminal and having a drain connected to the signal input terminal.

In the voltage regulator, the first p-channel MOS transistor may have current driving power stronger than the current driving power of the second p-channel MOS transistor.

In the voltage regulator, the equalizer may be formed by a comparator and an inverter; and the voltage regulator further comprises a MOS transistor switch connected between ground and the resistance voltage divider for stopping any circuit other than the comparator.

In the voltage regulator, the inverter may be formed by complementary p-channel and n-channel MOS transistors.

In the voltage regulator, the inverter may be formed by a p-channel MOS transistor and a constant current circuit.

In the voltage regulator, the inverter may be formed by a p-channel MOS transistor and a resistor.

BRIEF DESCRIPTION OF THE DRAWINGS

Other objects, features, and advantages of the present invention will become apparent from the following detailed description when read in conjunction with the accompanying drawings, in which.

DESCRIPTION OF THE PREFERRED EMBODIMENTS

In the following, embodiments of the present invention are described with reference to the accompanying drawings.

Figure 1:
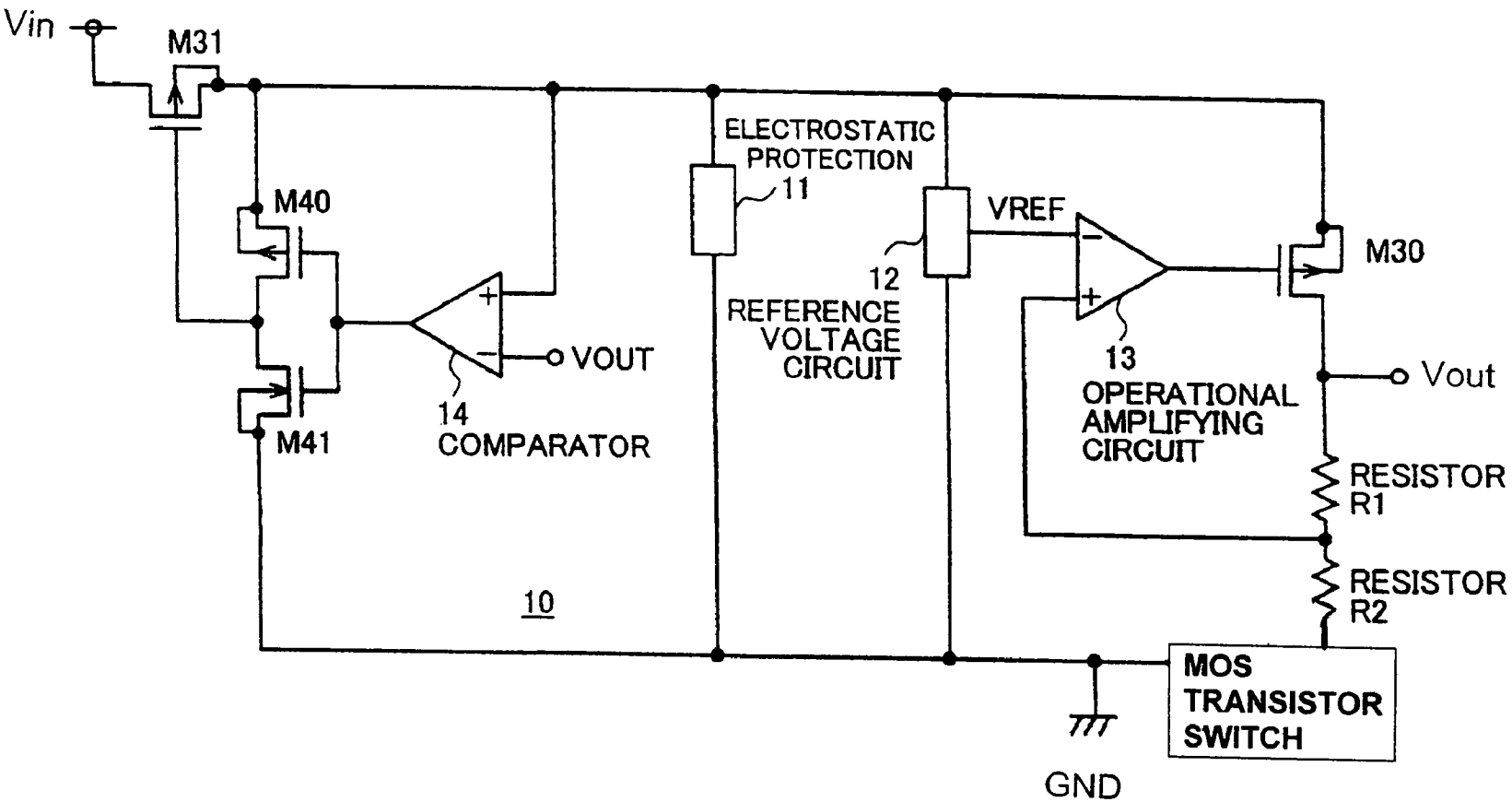
FIG. 1 is a circuit diagram of a voltage regulator according to a first embodiment of the present invention.

FIG. 1 is a circuit diagram illustrating a voltage regulator 10 according to a first embodiment of the present invention.

Figure 5:
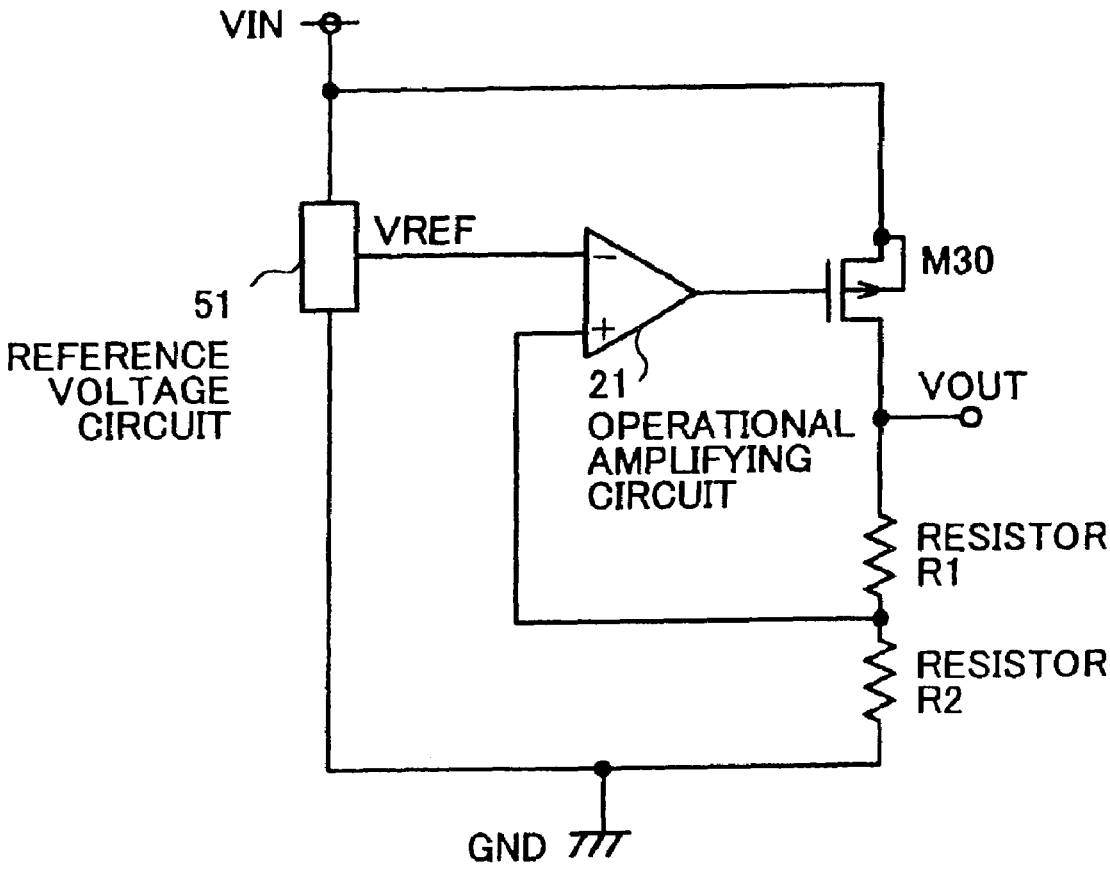
FIG.5 (PRIOR ART)
FIG. 5 is a circuit diagram of a conventional voltage regulator.
Figure 6:
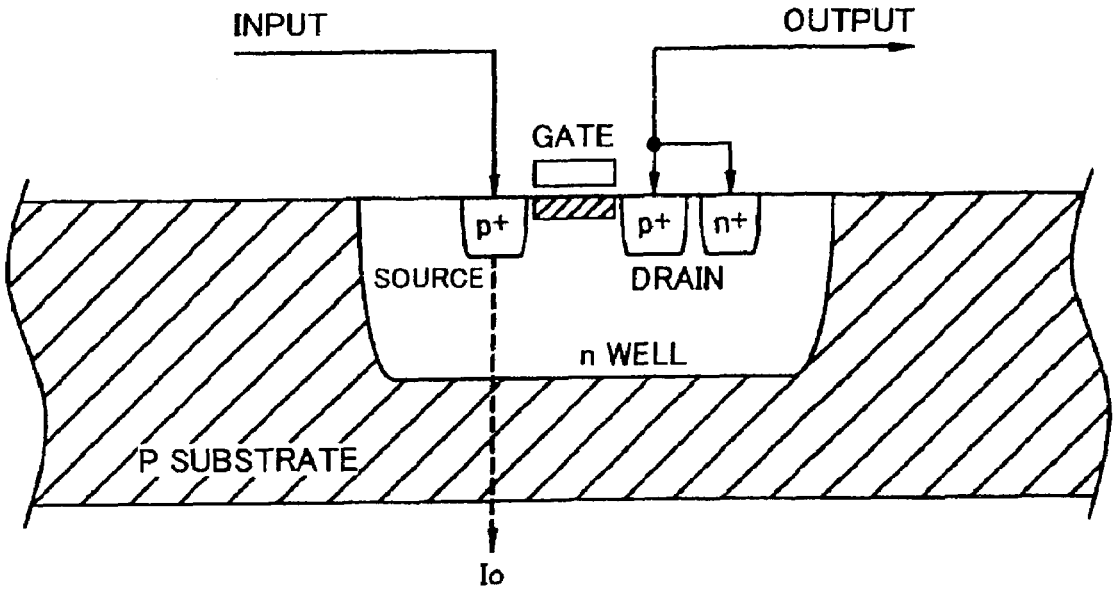
FIG.6 (PRIOR ART)
FIG. 6 is a schematic diagram of a MOS transistor showing a parasitic vertical PNP bipolar transistor.

The voltage regulator 10 shown in this embodiment comprises a reference voltage circuit 12 (providing a reference voltage VREF), an operational amplifying circuit 13, a p-channel MOS transistor M30, and resistors R1 and R2 as a resistance voltage divider, similar to a conventional voltage regulator as shown in FIG. 5. The voltage regulator 10 further comprises a p-channel MOS transistor M31 connected to an input terminal, an inverter formed by CMOS transistors M40, M41 connected to a source and a gate of the p-channel MOS transistor M31, a comparator 14 and an electrostatic protection device 11 in addition to the conventional voltage regulator portion. A control circuit including the CMOS transistor M40, M41 and the comparator 14 operates so that a gate voltage of the input terminal side p-channel MOS transistor M31 becomes equal to a source voltage thereof.

The comparator 14 compares the source voltage of the input terminal side p-channel M31 with an output voltage Vout of the voltage regulator.

In normal conditions where Vin is higher than Vout, the p-channel transistor M31 is ON, and therefore a source voltage and a drain voltage of the transistor M31 are substantially equal to each other. Accordingly, the comparator 14 compares the input voltage Vin with the output voltage Vout.

On the other hand, in case where Vin is lower than Vout, the output of the comparator 14 becomes low. Then, the transistor M40 turns on and the output of the inverter formed by the transistors M40 and M41 becomes high. The gate voltage of the transistor M31 becomes equal to its source voltage, and therefore the p-channel transistor M31 turns off. The comparator 14 and the transistor M40 function as an equalizer that equalizes the gate voltage and the source voltage of the p-channel transistor M31.

The p-channel MOS transistor M31 has its drain at the input voltage Vin side, and the drain-well PN junction is backwardly biased. Accordingly, no current flows from the output terminal to the input terminal. The comparator 14 and the CMOS transistors M40, M41 function as a cut-off circuit.

Then the voltage regulator consumes only currents that flow through the resistors R1, R2, the comparator 14 and the reference voltage circuit 12. In this manner, the voltage regulator 10 can realize reverse current prevention against a reverse voltage applied between the input terminal and the output terminal of the voltage regulator 10.

In an alternative embodiment similar to the voltage regulator 10 shown in FIG. 1, a MOS transistor switch can be inserted between ground and the resistors R1, R2 in order to cut off current flowing from the resistors to ground. In this way it is possible to stop any circuit other than the comparator 14, which should operate as a detecting circuit, and reverse current can be prevented while Vin is lower than Vout. In this alternative embodiment, the voltage regulator only consumes current that is consumed in the comparator 14.

Figure 2:
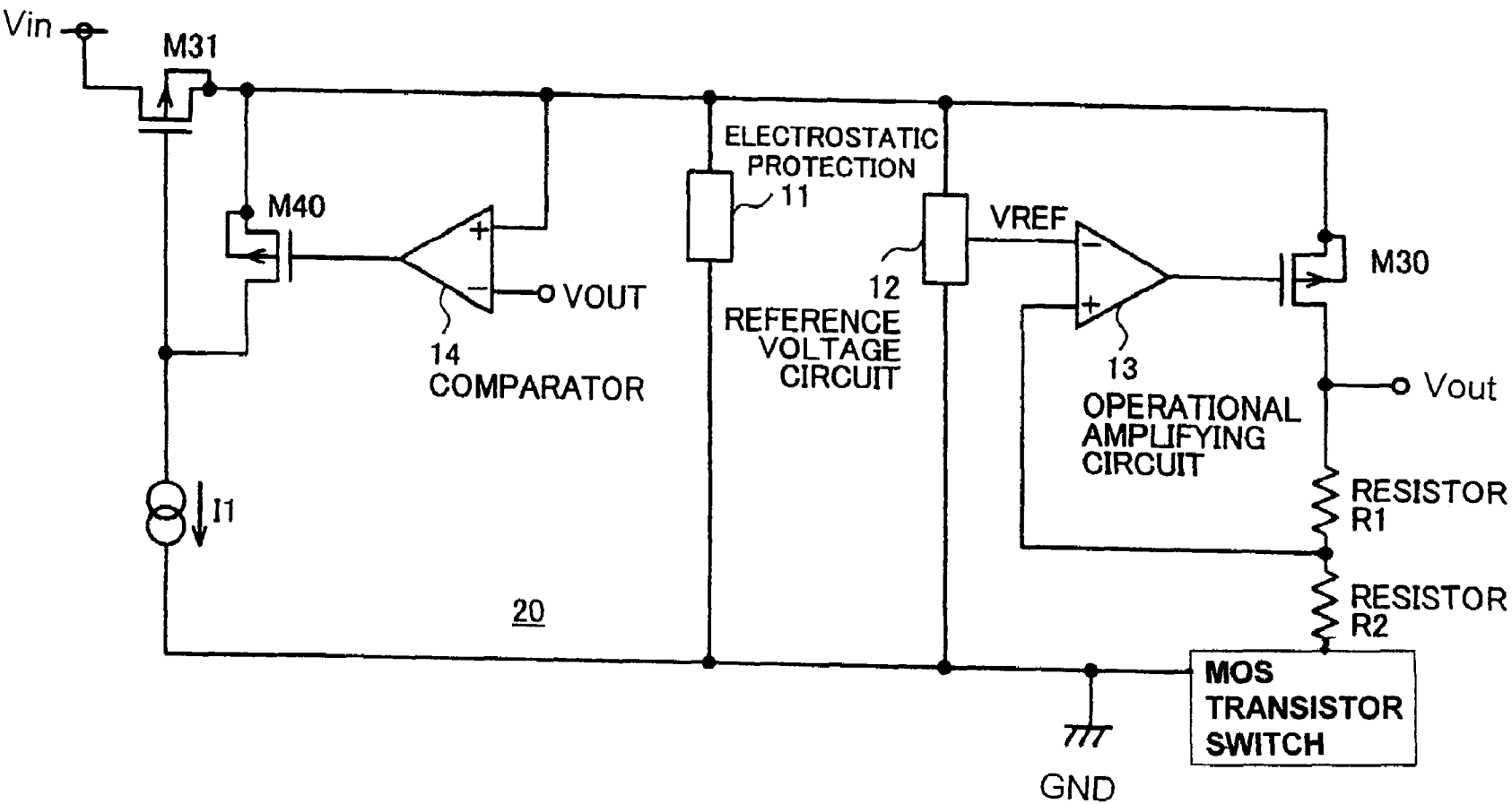
FIG. 2 is a circuit diagram of a voltage regulator according to a second embodiment of the present invention.

FIG. 2 is a circuit diagram illustrating a voltage regulator 20 according to a second embodiment of the present invention.

The voltage regulator 20 shown in FIG. 2 is different from the voltage regulator 10 shown in FIG. 1 in that it employs a constant current circuit I1 instead of the transistor M41. In this embodiment, when Vin becomes smaller than Vout, an output of a comparator 14 becomes low, an output of a transistor M40 becomes high to cause a gate voltage of a transistor M31 to be equal to its source voltage and cause the transistor M31 to turn off.

Since the transistor M31 turns off, reverse current prevention can be realized also in the second embodiment.

When Vin becomes higher than Vout, the output of the comparator 14 becomes high and the output of the transistor M40 becomes low to make the transistor M31 turn on. In this situation, a gate current flows through the constant current circuit I1.

In a further alternative voltage regulator according to a third embodiment of the present invention, a resistor (not shown) can be used instead of the transistor M41 shown in FIG. 1. Also in this case, the comparator 14, the transistor M40 and the transistor M31 operate the same as in the operation shown in FIG. 2.

In this way protection is obtained against reverse voltage.

A case where GND voltage is higher than an input voltage is explained below.

In the embodiments shown in FIG. 1 and FIG. 2, when GND voltage becomes higher than the input voltage Vin, a source voltage, a well voltage and a gate voltage (grounded) of the transistor M31 become equal, and therefore the transistor turns off. The drain-well PN junction of the transistor M31 is backwardly biased. Accordingly, no current flows from ground to the input terminal and reverse current is prevented.

Also in this case, a constant current circuit I1 or a resistor can be used instead of the transistor M41 like in the reverse voltage protection case.

Figure 3:
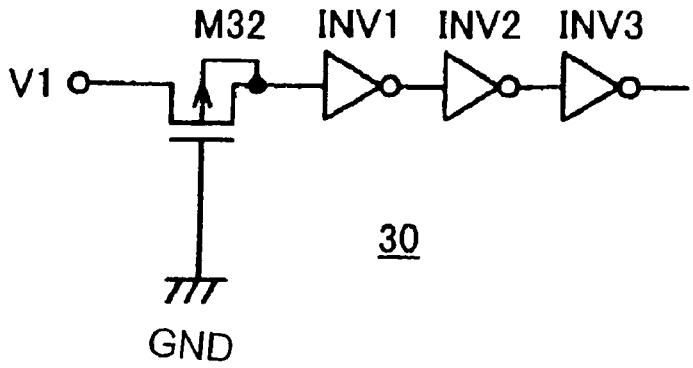
FIG. 3 is a circuit diagram of a voltage regulator IC according to a third embodiment of the present invention, showing a signal input terminal provided in the voltage regulator IC.
Figure 4:
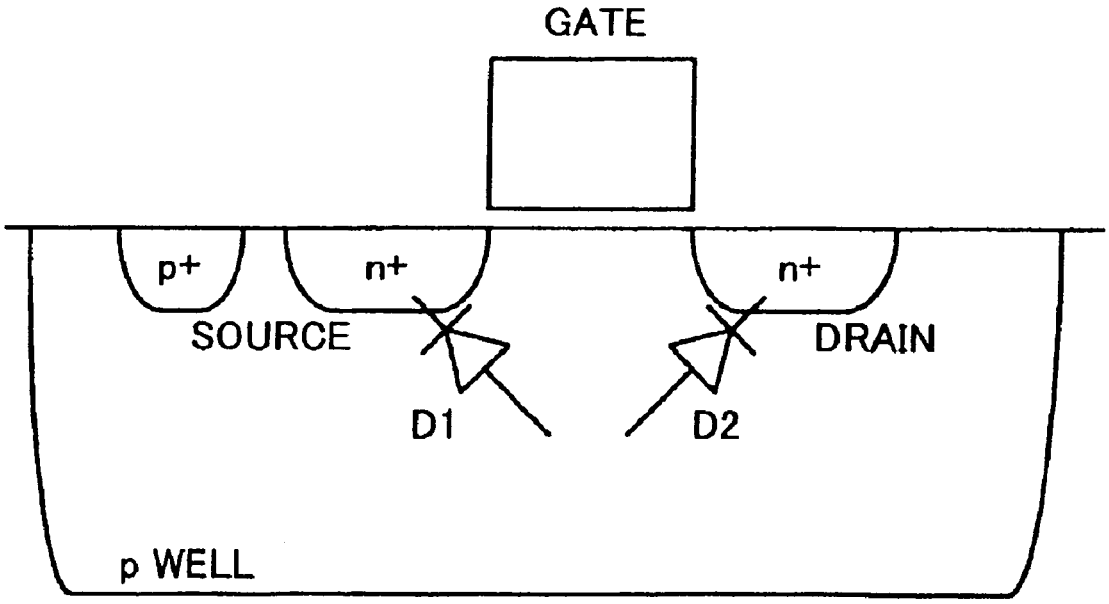
FIG.4 (PRIOR ART)
FIG. 4 is a schematic diagram of a MOS transistor showing parasitic PN diodes.

FIG. 3 is a circuit diagram illustrating a voltage regulator IC 30 according a third embodiment of the present invention. The voltage regulator IC 30 has a signal input terminal V1. This embodiment shows that a p-channel MOS transistor M32 can be used at an input of a control circuit for controlling the IC chip.

A drain of the p-channel MOS transistor M32 is connected to the signal input terminal V1, and a gate thereof is connected to ground GND. When GND voltage becomes higher than an input voltage, a source voltage, a well voltage and a gate voltage of the transistor M32 become equal, and the transistor turns off. In this manner, reverse current can be prevented even when the signal input terminal V1 is connected in reverse or an output terminal voltage is higher than an input terminal voltage V1.

Although FIG. 3 shows an example where a signal from the outside is input to inverters INV1, INV2 and INV3, reverse current prevention the same as the above can be obtained for a source or drain of a transistor.

In CMOS voltage regulators according to the embodiments of the present invention, reverse current protection is obtained against reverse voltage input and input/output reverse connection, without lowering an input voltage.

The embodiments of the present invention provide significant advantage when they are applied to a voltage regulator in which a MOS transistor is used as a driver. This advantage is not affected even if the reference voltage circuit 12 or the operational amplifying circuit 13 uses bipolar transistors.

According to the embodiments of the present invention, two MOS transistors are provided at a voltage input terminal and a voltage output terminal of a voltage regulator, respectively. A drain of the input terminal side MOS transistor is connected to the input terminal, and a threshold voltage or a voltage lower than the threshold voltage is applied to a gate of the input terminal side MOS transistor. On the other hand, a drain of the output terminal side MOS transistor is connected to the output terminal. The threshold voltage is a voltage required for turning on a p-channel MOS transistor.

Even if a reverse voltage is applied to the input terminal, no reverse current flows through the input terminal side p-channel MOS transistor, unless a voltage higher than a breakdown voltage is applied. When a normal forward voltage is applied to the input terminal, the input terminal side p-channel MOS transistor turns on and can avoid voltage drop across itself.

Since the voltage regulator has an equalizer, which equalizes gate and source voltages of the input terminal side p-channel MOS transistor when an output voltage becomes higher than an input voltage, an excess of reverse current does not flow.

If current driving power of an input terminal side p-channel MOS transistor is lower than the current driving power of an output terminal side p-channel MOS transistor, an input current flows through a channel region rather than through a parasitic diode formed by a drain and an n-well of the input terminal side p-channel MOS transistor, and therefore a parasitic bipolar transistor formed by the drain, the n-well and a p-substrate does not turn on, not allowing the input current to flow to the substrate.

The present invention is not limited to these embodiments, but variations and modifications may be made without departing from the scope of the present invention.

What is claimed is:

1. A voltage regulator having a voltage input terminal and a voltage output terminal, comprising:

a first p-channel MOS transistor and a second p-channel MOS transistor connected in series between the voltage input terminal and the voltage output terminal, the first p-channel MOS transistor having a drain connected to the voltage input terminal and a gate to which a voltage less than or equal to a threshold voltage is applied, the second p-channel MOS transistor having a drain connected to the voltage output terminal; and a voltage regulator circuit comprising an operational amplifier, a reference voltage circuit, and a resistance voltage divider;

wherein the voltage regulator circuit and the second p-channel MOS transistor are driven by a current flowing through the first p-channel MOS transistor; and wherein said voltage regulator further comprises a cut-off circuit including an equalizer that equalizes gate and source voltages of the first p-channel MOS transistor to stop a current from the voltage output terminal to the voltage input terminal when a voltage at the voltage output terminal is higher than a voltage at the voltage input terminal.

2. The voltage regulator as claimed in claim 1, wherein:

the equalizer is formed by a comparator and an inverter; and the voltage regulator further comprises a MOS transistor switch connected between a ground and the resistance voltage divider for stopping any circuit other than the comparator.

3. The voltage regulator as claimed in claim 2, wherein: the inverter is formed by complementary p-channel and n-channel MOS transistors.

4. The voltage regulator as claimed in claim 2, wherein: the inverter is formed by a p-channel MOS transistor and a constant current circuit.

5. The voltage regulator as claimed in claim 2, wherein: the inverter is formed by a p-channel MOS transistor and a resistor.

* * * * *